United States Patent [19]

Trinh et al.

[11] Patent Number: 4,833,482

[45] Date of Patent: May 23, 1989

[54] CIRCULARLY POLARIZED MICROSTRIP ANTENNA ARRAY

[75] Inventors: Trang N. Trinh, Cypress; H. John Kuno, Rancho Palos Verdes, both of Calif.

[73] Assignee: Hughes Aircraft Company, Los Angeles, Calif.

[21] Appl. No.: 160,449

[22] Filed: Feb. 24, 1988

[51] Int. Cl.[4] ..... H01Q 1/38

[52] U.S. Cl. ..... 343/700 MS; 343/853

[58] Field of Search ..... 343/700 MS, 829, 846, 343/853

[56] References Cited

U.S. PATENT DOCUMENTS

| | | | |
|---|---|---|---|
| 4,063,245 | 12/1977 | James et al. | 343/700 MS |
| 4,071,846 | 1/1978 | Oltman | 343/700 MS |
| 4,180,817 | 12/1979 | Sanford | 343/700 MS |
| 4,217,549 | 7/1980 | Henoch | 455/81 |

FOREIGN PATENT DOCUMENTS

| | | | |
|---|---|---|---|
| 0071069 | 7/1982 | European Pat. Off. | 343/700 MS |
| 2824053 | 12/1978 | Fed. Rep. of Germany | 343/700 MS |
| 97703 | 7/1980 | Japan | 343/700 MS |
| 38004 | 3/1982 | Japan | 343/700 MS |

*Primary Examiner*—William L. Sikes
*Assistant Examiner*—Michael C. Wimer
*Attorney, Agent, or Firm*—Terje Gudmestad; A. W. Karambelas

[57] ABSTRACT

An antenna arrangement is disclosed for radiating and receiving circularly polarized radiation. A first antenna array having parallel stripline conductors is disposed on the top surface of a dielectric substrate. The stripline conductors have radiating tabs protruding outwardly therefrom in a direction about 45 degrees from the stripline conductors. A second antenna array having a second plurality of stripline conductor is disposed on the substrate. The second stripline conductors are interdigitated with the first stripline conductors. The second stripline conductors also have a plurality of outwardly protruding radiating elements which form about a 90 degree angle with the first radiating elements. The first and second antenna arrays are fed with two independent signals about 90 degrees apart and will independently radiate a horizontally linearly polarized wave and a vertically linearly polarized wave respectively, which becomes a circularly polarized wave at far field. The interdigitated antenna pattern allows a compact antenna arrangement to be fabricated while lessening the tendency of adjacent antennas to cross-couple and distort the transmitted signal.

16 Claims, 1 Drawing Sheet

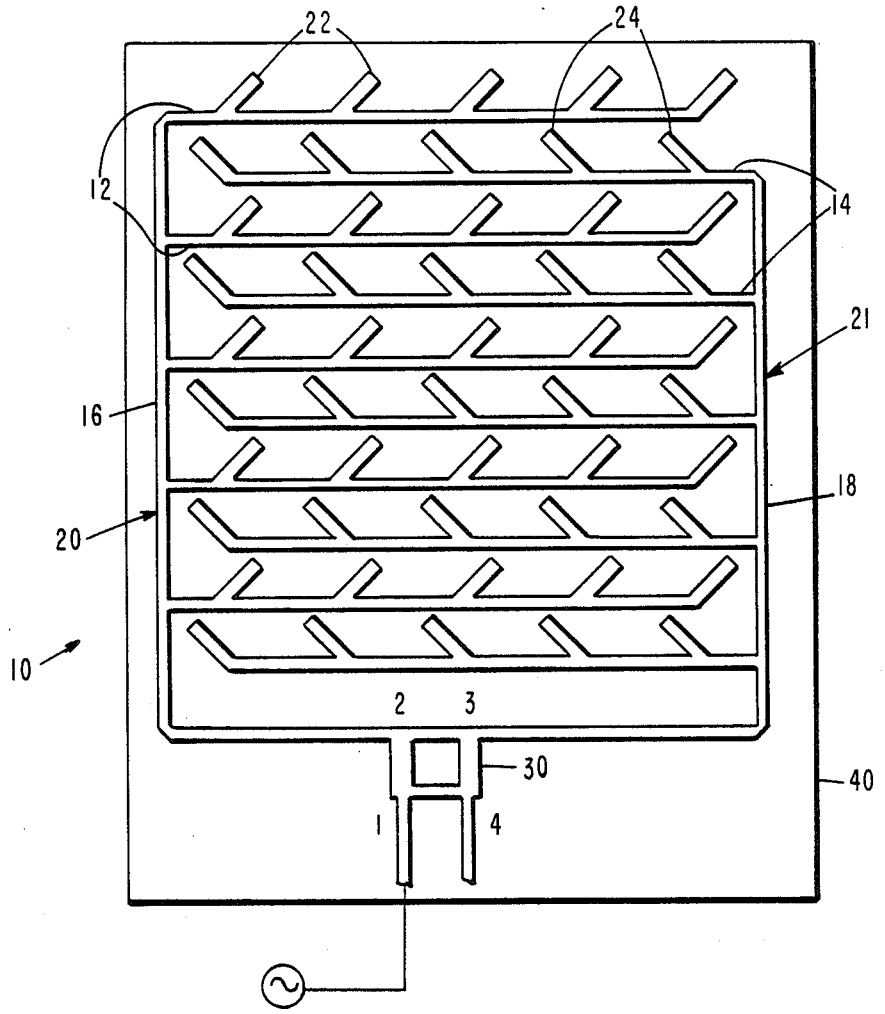
22
24
12
14
21
16
18
20
10
2
3
30
40
1
4

CIRCULARLY POLARIZED MICROSTRIP ANTENNA ARRAY

BACKGROUND OF THE INVENTION

1. Field of the Invention

This invention relates to microstrip antenna structures and more particularly to microstrip antenna arrays which radiate and receive circularly polarized electromagnetic radiation.

2. Background of the Invention

In the past various antenna arrangements have been developed to transmit and receive circularly polarized microwave radiation. A classical arrangement is the horn antenna which is disclosed in European Pat. No. 0,071,069 issued to Werner Lange on Feb. 9, 1983. Lange's microwave antenna includes a horn shaped waveguide and two excitation radiators arranged orthoganally to one another and perpendicular to the axis of the horn waveguide. The excitation radiators are driven from a 90 degree 3 dB hybrid coupler. This antenna arrangement, however, is expensive and difficult to manufacture. Additionally, it is rather large and therefore cannot be used in applications requiring compact transceivers.

Another conventional antenna arrangement is disclosed in U.S. Pat. Nos. 4,180,817 and 4,217,549, issued to Gary Sanford and Bengt Henoch, respectively. Sanford and Henoch disclose a two-dimensional antenna array having a plurality of square radiating elements arranged in rows and columns. Each square radiating element is excited by two signals 90 degrees out of phase which are applied to adjacent sides of the element. Each square radiating element therefore radiates two signals, one of a first polarization and the other of a second polarization. However, since two signals are applied to each radiating element, these two signals tend to cross-couple which may distort the transmitted signals. Additionally, the radiating elements must be exactly square to radiate circularly polarized radiation and not elliptically polarized radiation. This factor can adversely increase manufacturing costs.

In a further development which is in pending application No. 984,526, now U.S. Pat. No. 4,742,354 and assigned to the same assignee herein, a transceiver is disclosed having two linearly polarized antennas arranged orthogonally side by side. However, in certain applications, such as automobile anticollision radar transceivers, it is desirable to have even a more compact antenna arrangement.

SUMMARY OF THE INVENTION

It is therefore an object of this invention to provide an antenna arrangement that radiates and receives circularly polarized radiation and at the same time is simple, compact and easy to manufacture.

It is a feature of this invention to have two independent linearly polarized arrays which are disposed adjacent to each other but spaced apart mitigating cross-coupling.

A circularly polarized antenna arrangement according to the present invention includes a pair of linearly polarized antenna arrays each array having a plurality of essentially parallel stripline conductors. Each stripline conductor has a plurality of radiating elements protruding outwardly therefrom. The linearly polarized antenna arrays are arranged in an interdigitated pattern, with the radiating elements of one antenna array being essentially orthononal to the radiating elements of the other antenna array. The antenna arrays are coupled to different terminals of a quadrature coupler, such that one antenna array will radiate a signal of a substantially first polarization, and the other antenna array will radiate a second signal of a substantially second polarization, about ninety degrees out of phase with said first signal.

Since the two antenna arrays are arranged in an interdigitated pattern, the circularly polarized antenna can be made very compact. However, because the two antennas are spaced apart from one another, crosscoupling will be reduced and substantially circularly polarized radiation achieved.

Additional objects, advantages and characteristic features of the present invention will become readily apparent from the following detailed description of the preferred embodiment of the invention when considered in conjunction with the accompanying drawing.

BRIEF DESCRIPTION OF THE DRAWING

The sole figure is a plain view of a circularly polarized antenna arrangement constructed in accordance with the invention.

DETAILED DESCRIPTION

Referring now with greater particularity to the figure, there is shown an antenna structure according to the principles of the invention which includes a plurality of essentially parallel and coplanar non-radiating microstrip transmission lines 12 and 14. These transmission lines are stripline conductors, of copper for example, and are spaced apart about one wavelength based on the desired operating frequency of the antenna. Non-radiating microstrip transmission lines 12 and 14 are coupled together by nonradiating microstrip transmission lines 16 and 18, respectively, which also may be copper stripline conductors. Accordingly, microstrip transmission lines 12 and 14 form a plurality of fingers which are arranged in an interdigitating pattern. The non-radiating microstrip transmission lines 12, 14, 16 and 18 all may have an impedance of 50 ohms to match the impedence of 3 bB quadrature coupler 30. The quadrature coupler 30 generally has four ports as indicated by numerals 1, 2, 3 and 4 in the figure. Microstrip transmission line 16 is electrically coupled to terminal 2 of the quadrature coupler, and microstrip transmission line 18 is electrically coupled to terminal 3.

Stripline conductors 12 and 14 each have a plurality of radiating elements disposed along the conductors. The radiating elements 22 and 24 are preferably substantially rectangular in shape; however, other shapes can be used. Radiation elements 22 and 24 protrude outwardly from the sides of conductors 12 and 14, extending therefrom about $\frac{1}{2}$ wavelength. Radiating elements 22 and 24 may be spaced apart along their respective transmission lines by typically about $\frac{1}{2}$ wavelength based on the desired operating frequency or integral multiples thereof; however a spacing of one wavelength is preferred. Additionally, the radiating elements 22 and 24 may be about $\frac{1}{8}$ wavelength wide and desireably match the impedance of transmission lines 12 and 14, to minimize any losses. Radiating elements 22 and 24 may form an angle of about 45 degrees with their respective stripline conductors 12 and 14, and are co-planar therewith. However, the respective radiating elements 22 and 24 of adjacent pairs of microstrip transmission lines 12 and 14 are arranged orthoganally to each other.

Microstrip transmission lines 16 and 18 are electrically coupled to terminals 2 and 3 of 3 dB quadrature coupler, respectively. Quadrature coupler 30 may be a 3 dB branchline coupler, a line coupler, or a lumped element, for example. Any signal to be transmitted by the antenna arrangement 10 is fed into terminal 1 of quadrature coupler 30. Quadrature coupler 30 splits this signal into two signals of about the same amplitude but 90 degrees out of phase, which signals appear at terminals 2 and 3. The signals at terminals 2 and 3 are in turn fed through microstrip transmission lines 16 and 18, and 12 and 14 respectively, ito radiating elements 22 and 24. Accordingly, radiating elements 22 will radiate a first signal of a substantially first polarization, e.g., a horizontally linearly polarized wave, and radiating elements 24 will radiate a second signal of a substantially second polarization, e.g., a vertically linearly polarized wave. At far-field, i.e., about 10 wavelengths away from antenna 10, these horizontally and vertically linearly polarized waves will form a single circularly polarized waveform. To generate a circularly polarized waveform, the electrical distance of transmission lines 16 and 18 should desireably be equal. The number of stripline conductors 12 and 14, as well as the number and the geometry of the radiating elements 22 and 24, may be varied to achieve the desired radiation pattern and beam width.

Antenna 10 also receives any signals reflected back toward it. Upon reflection by a distant object, the sense of the circularly polarized waveform will be reversed. The two antenna arrays 20 and 21 receive the two orthogonal components, e.g., the horizontal and vertical components, of the circularly polarized waveform, which appear at terminals 2 and 3 of quadrature coupler 30. Quadrature coupler 30 recombines the two orthogonal components into a single signal which appears at terminal 4.

The antenna arrays 20 and 21 and quadrature coupler 30 may be mounted on dielectric substrate 40. The dielectric substrate may be of Teflon based fiberglass having an underlying conductive layer which may be copper. Accordingly, antenna arrangement 10 may be fabricated using standard printed circuit board techniques. An off-the-shelf dielectric substrate, which may be copper-clad on both sides, may be used. The copper on one side is merely etched away using techniques well known in the art to yield the conductor patterns shown in the figure. The copper clad on the opposite side of the board serves as the ground plane.

The antenna circuit structure and layout shown and described above provides a high degree of isolation between the transmitted orthogonal linearly polarized signals. Additionally, interdigitating the antenna arrays provides a compact antenna arrangement.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. A circularly polarized antenna arrangement, comprising:

a pair of linearly polarized antennas for radiating and receiving circularly polarized electromagnetic radiation, each antenna having a plurality of essentially parallel finger-like stripline conductors arranged in an interdigitated pattern, each of said stripline conductors having a plurality of radiating elements protruding outwardly therefrom along one side, said protruding radiating elements along said stripline conducors of one of said antennas being arranged orthogonally to and on the same respective side as said protruding radiating elements along said stripline conductors of the other of said antennas.

2. An antenna arrangement as defined in claim 1 wherein said protruding radiating elements form about a 45 degree angle with their respective stripline conductor.

3. An antenna arrangement as defined in claim 1 further including a quadrature coupler having first, second, third and fourth branchline terminals, said linearly polarized antennas being electrically coupled between said second and third branchline terminals.

4. An antenna arrangement as defined in claim 3 further comprising a dielectric substrate, wherein said antennas and quadrature coupler are mounted on said dielectric substrate.

5. An antenna arrangement as defined in claim 3 further comprising means for generating a signal, said first branchline terminal of said quadrature coupler being electrically coupled to said signal generating means.

6. An antenna arrangement as defined in claim 1 wherein said protruding radiating elements are about one-half wavelength long and are spaced about one wavelength apart based on the desired operating frequency of the antenna arrangement.

7. An antenna arrangement as defined in claim 6 wherein said stripline conductors are spaced apart about one-half wavelength based on the desired operating frequency of the antenna arrangement.

8. An antenna array arrangement for transmitting and receiving circular polarized electromagnetic radiation of an anticipated operating frequency, comprising:

a dielectric substrate;

a first linearly polarized antenna including at least one first stripline conductor having a second plurality of conductive radiating tabs protruding outwardly therefrom along one side thereof, said first antenna being disposed on said substrate;

a second linearly polarized antenna including at least one second stripline conductor having a second plurality of conductive radiating tabs protruding outwardly therefrom along one side thereof; and said second antenna being disposed on said substrate such that said stripline conductors of said first and second antennas are substantially parallel to each other and said first producing radiating tabs of said first antenna are arranged essentially orthogonal to said second protruding radiating tabs of said second antenna, said first and second protruding tabs being disposed on the same respective sides of said first and second stripline conductors.

9. An antenna array as defined in claim 8 further including a quadrature coupler having first, second, third, and fourth branchline terminals, said first and second antennas being electrically coupled between said second and third branchline terminals of said quadrature coupler.

10. An antenna arrangement as defined in claim 9 further including means for providing a signal to the first branchline terminal of said quadrature coupler.

11. An antenna arrangement as defined in claim 8 where said radiating tabs are about one-half wavelength long and are spaced about one wavelength apart along said conductors based on the anticipated operating frequency of the antenna array arrangement.

12. A circularly polarized antenna arrangement having two linearly polarized antennas for radiating two independent linearly polarized electromagnetic waves about 90 degrees out of phase, comprising:

a dielectric substrate;

a first antenna array having a first plurality of essentially parallel stripline conductors coupled together at one end, each of said first stripline conductors having a plurality of first radiating elements protruding outwardly therefrom along one side of said first stripline conductors in a first preselected direction;

a second antenna array having a second plurality of essentially parallel stripline conductors coupled together at one end, each of said second stripline conductors having a plurality of second radiating elements protruding outwardly therefrom along one side of said second stripline conductors in a second preselected direction which is about 90 degrees from said first preselected direction;

said first and second antenna arrays being interdigitatedly mounted on said dielectric substrate such that said first and second protruding radiating elements are disposed along the same respective sides of said first and second stripline conductors; and a 3 dB quadrature coupler having first, second, third and fourth branchline terminals, said first and second antenna arrays being electrically coupled to said second and third branchline terminals respectively.

13. An antenna arrangement as defined in claim 12 wherein said first and second radiating elements form about a 45 degree angle with their respective first and second stripline conductors.

14. An antenna array as defined in claim 12 wherein said first and second plurality of radiating elements are substantially rectangular in shape.

15. An antenna arrangement as defined in claim 12 wherein said first and second plurality of radiating elements are spaced about one wavelength apart based on the desired operating frequency of the antenna arrangement along said first and second stripline conductors, respectively.

16. An antenna arrangement as defined in claim 15 wherein said first stripline conductors are spaced apart about one wavelength and said second stripline conductors are spaced apart about one wavelength, based on the desired operating frequency of the antenna arrangement.

* * * * *